US007775835B2

(12) United States Patent
Ting et al.

(10) Patent No.: US 7,775,835 B2
(45) Date of Patent: Aug. 17, 2010

(54) ELECTRICAL CARD CONNECTOR

(75) Inventors: Chien-Jen Ting, Tu-cheng (TW); Ming-Lun Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 186 days.

(21) Appl. No.: 12/220,504

(22) Filed: Jul. 24, 2008

(65) Prior Publication Data

US 2009/0029595 A1 Jan. 29, 2009

(30) Foreign Application Priority Data

Jul. 24, 2007 (TW) ..... 96126864 A

(51) Int. Cl.
*H01R 24/00* (2006.01)

(52) U.S. Cl. ..... 439/630

(58) Field of Classification Search ..... 439/630, 439/629, 638, 946
See application file for complete search history.

(56) References Cited

U.S. PATENT DOCUMENTS 6,482,030 B1 11/2002 Kuo
6,641,441 B2 * 11/2003 Liu ..... 439/630
7,500,879 B2 * 3/2009 Ting et al. ..... 439/630
7,503,805 B2 * 3/2009 Chang et al. ..... 439/630
7,517,237 B2 * 4/2009 Ting ..... 439/159
7,559,775 B2 * 7/2009 Lin et al. ..... 439/102
7,628,652 B2 * 12/2009 Ting ..... 439/630

FOREIGN PATENT DOCUMENTS

CN 2520589 Y 11/2001
CN 2520014 11/2002
CN 2520014 Y 11/2002

* cited by examiner

*Primary Examiner*—Xuong M Chung-Trans
(74) *Attorney, Agent, or Firm*—Andrew C. Cheng; Wei Te Chung; Ming Chieh Chang

(57) ABSTRACT

An electrical card connector (100) includes a metal shield (1), an insulated housing (2) and a terminal module (3) having a plurality of terminals (33) received therein. The metal shield covers the insulated housing to define a card receiving room and a card insertion/ejection direction. The insulated housing defines a receiving cavity (24, 25) and forms an elastic piece (26). The terminal module is slidably received in the receiving cavity of the insulated housing along the card ejection direction and is fixed in the insulated housing by the elastic piece.

9 Claims, 4 Drawing Sheets

ELECTRICAL CARD CONNECTOR

BACKGROUND OF THE INVENTION

1. Field of the Invention

The present invention relates generally to electrical card connectors, and more particularly to an electrical card connector having a better electrical performance.

2. Description of Related Arts

A smart card connector usually includes an insulating housing, a plurality of terminals arranged in two-row arrays and received in the insulating housing and a metal shield covering the insulating housing for preventing EMI. Smart card connectors are divided into two types in accordance with a relationship between the terminals and the insulating housing as below: a smart card connector with its terminals received in an electrical module separated from the insulating housing and another kind of smart card connector with its terminals integrated with the insulating housing. The assembling method of the first kind of smart card connector is usually that the integration of the metal shield and the insulating housing overlays the electrical module from a top side thereof. But such a method is disadvantaged in not so much fixed combination between the electrical module and the insulating housing that the insulating housing may be moved relative to the electrical module when the device is taken away. A bad electrical connection between an inserted smart card and the electrical card connector is achieved.

For another reason, a customer usually fixes the integration of the metal shield and the insulating housing onto a printed circuit board firstly, and acquires the electrical module having a plurality of terminals received therein to move into a receiving room defined in the insulating housing. The aforementioned electrical card connector does not satisfy the customer.

Hence, an improved electrical card connector having a better electrical performance and advanced assembling steps is desired.

SUMMARY OF THE INVENTION

Accordingly, an object of the present invention is to provide an electrical card connector having a better electrical performance and advanced assembling steps.

To achieve the above object, an electrical card connector includes a metal shield, an insulated housing and a terminal module having a plurality of terminals received therein. The metal shield covers the insulated housing to define a card receiving room and a card insertion/ejection direction. The insulated housing defines a receiving cavity and forms an elastic piece. The terminal module is slidably received in the receiving cavity of the insulated housing along the card ejection direction and is fixed in the insulated housing by the elastic piece.

Other objects, advantages and novel features of the invention will become more apparent from the following detailed description when taken in conjunction with the accompanying drawings.

DETAILED DESCRIPTION OF THE PREFERRED EMBODIMENT

Figure 1:
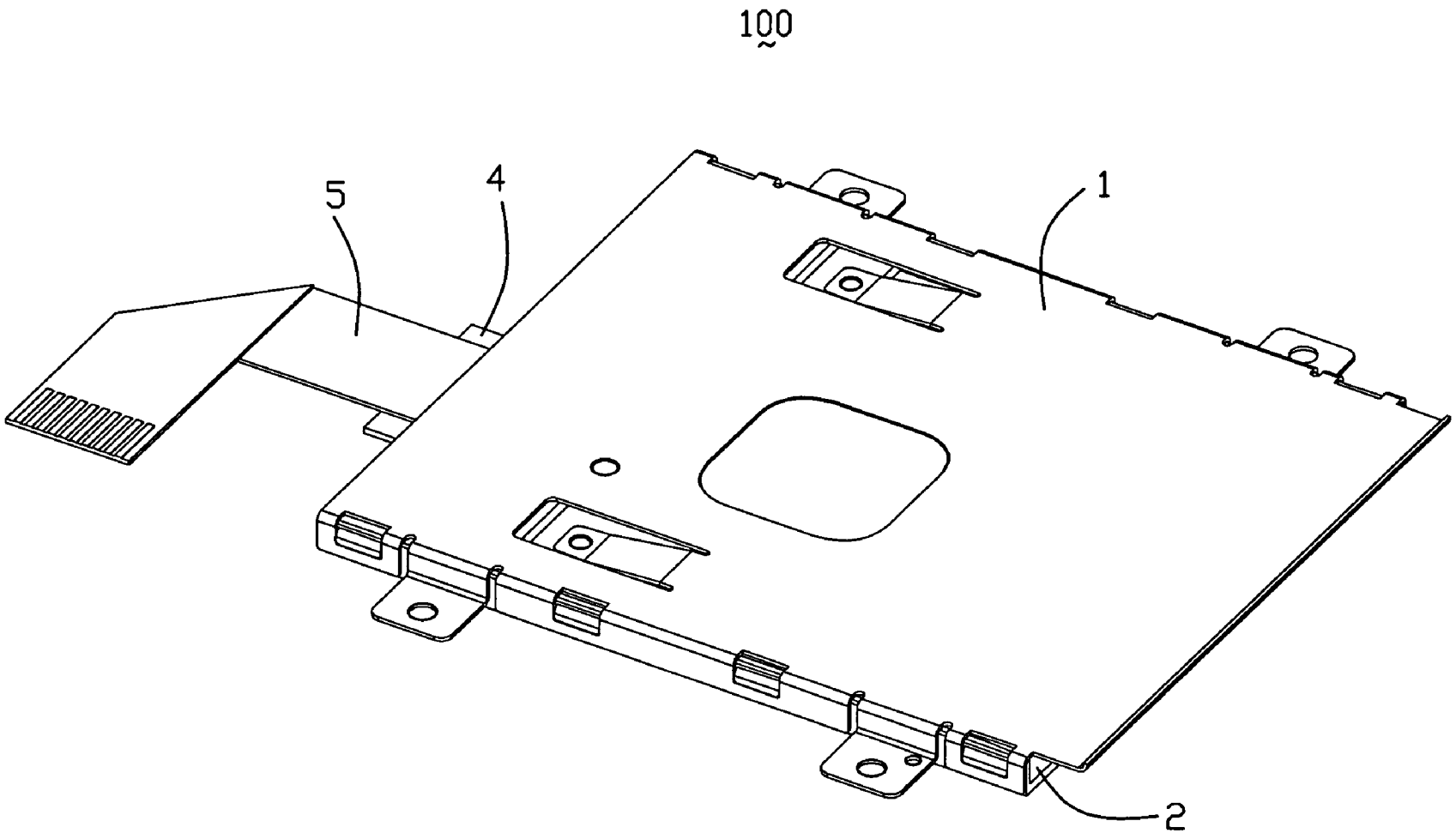
FIG. 1 is a perspective, assembled view of an electrical card connector according to the present invention.

Referring to FIGS. 1-4, an electrical card connector 100 according to a preferred embodiment of the invention comprises a metal shield 1, an insulated housing 2 and a terminal module 3 installed on the insulated housing 2. The metal shield 1 associates with the insulated housing 2 to define a card receiving room (not labeled), which is used to receive an electrical card (not shown) and accordingly, a card insertion/ejection direction is also defined thereby. In this embodiment, the electrical card connector 100 further comprises a minimized printed circuit board 4 which the terminal module 3 is attached to and a flexible circuit board 5 connected with the minimized printed circuit board 4.

Figure 3:
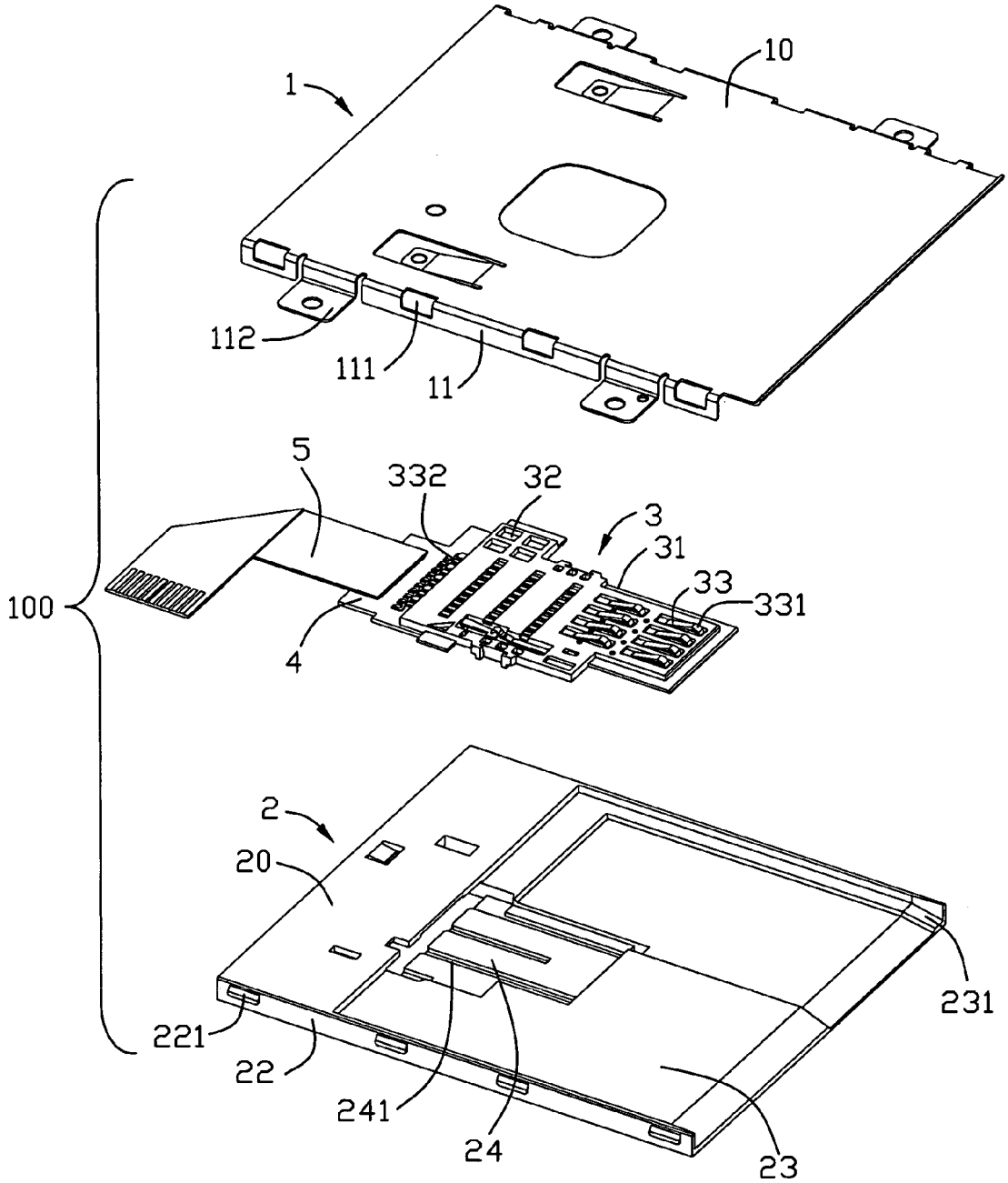
FIG. 3 is a perspective, exploded view of the electrical card connector.

Referring to FIG. 3, the metal shield 1 of a generally rectangular shape, comprises a base 10 and a pair of lateral sides 11 extending vertically and downwardly from two edges of the base 10. A plurality of apertures 111 is defined at an jointing section between the base 10 and each lateral side 11 and each lateral side 11 forms a plurality of orientation pieces 112 at the lowest edge thereof.

Figure 2:
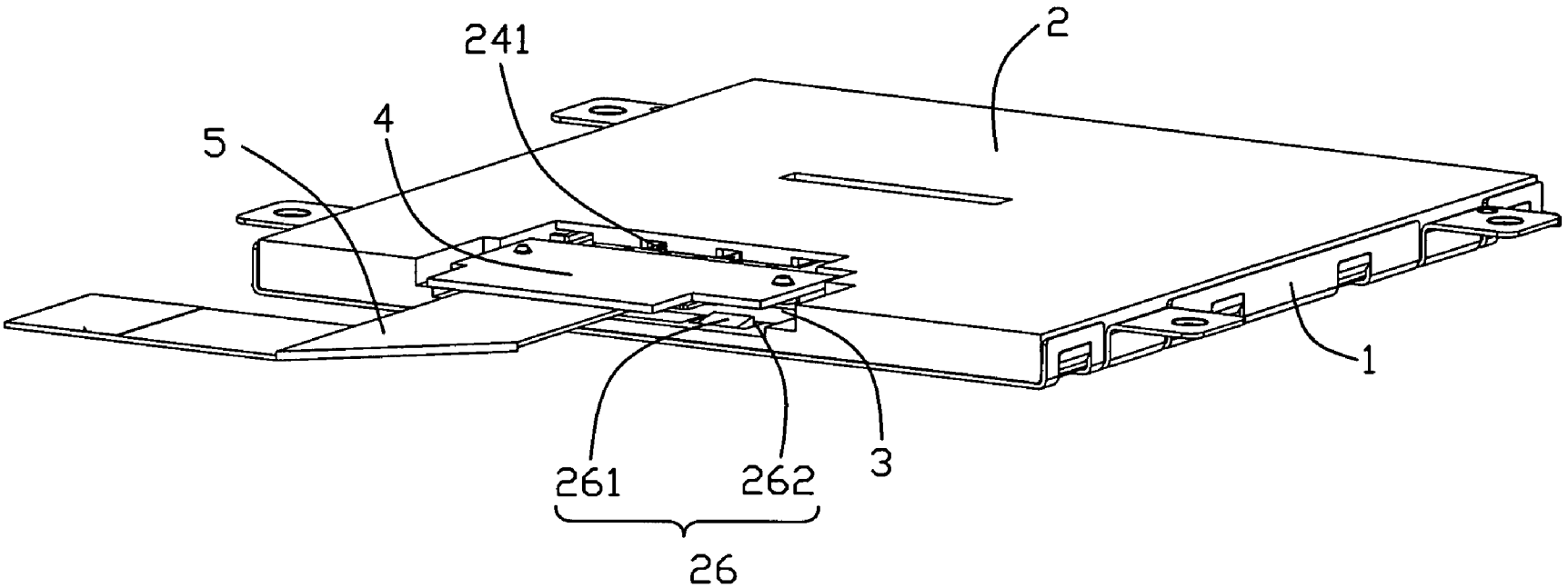
FIG. 2 is a view similar to FIG. 1, but taken from a different aspect.
Figure 4:
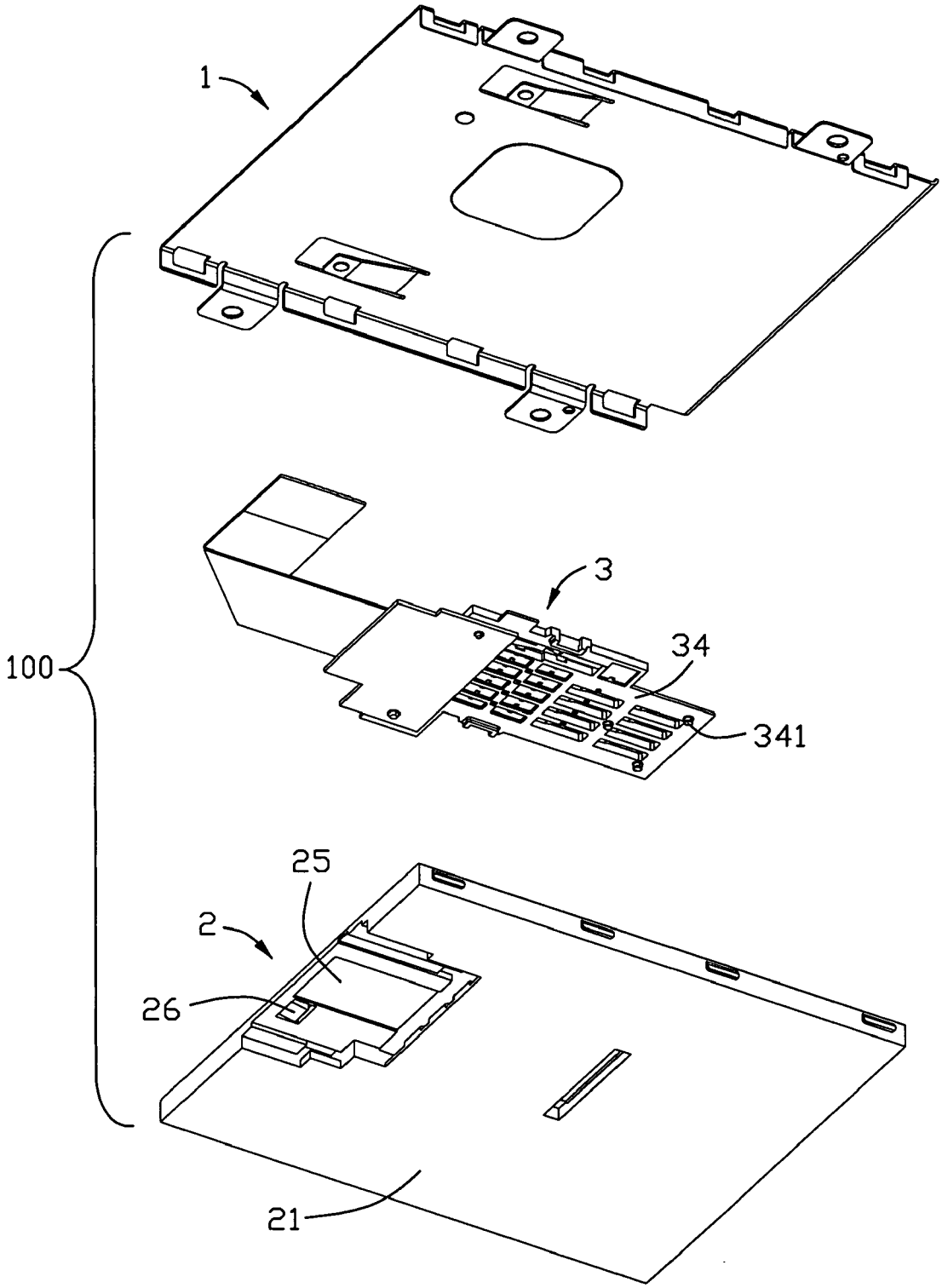
FIG. 4 is a view similar to FIG. 3, but taken from a different aspect.

Referring to FIGS. 2-4, the insulated housing 2 comprises an upper face 20, a lower face 21 and two lateral walls 22. Each lateral wall 22 forms a plurality of protrusions 221 protruding into the apertures 111 of the metal shield 1. The upper face 20 is excavated to leave a depressed portion 23 at a front part thereof. At a rear part of the depressed portion 23, the upper face 20 is further excavated to leave a first receiving cavity 24, which is located a lower height than the depressed portion 23, for partly receiving the terminal module 3. A plurality of channels 241 extending along the card insertion/ejection direction is defined in a portion of the insulated housing 2 located below the first receiving cavity 24. The lower face 21 is excavated to leave a second receiving cavity 25 at a rear part thereof and the two receiving cavities 24, 25 keep alone but communicate with each other. The insulated housing 2 located below the second receiving cavity 25 forms an elastic piece 26 at a rear part thereof. The elastic piece 26 protrudes into the second receiving cavity 25 and comprises an inclined surface 261 for guiding purpose and an upstanding surface 262 for confronting purpose.

Referring to FIGS. 3 and 4, the terminal module 3 comprises an L-shaped base portion 31, a rectangular base portion 32 extending from a rear part of the L-shaped base portion 31 and a plurality of terminals 33 received in the base portions 31, 32. The terminal 33 has a contact portion 331 and a soldering portion 332. The contact portions 331 of the terminals 33 are arranged in two-row arrays and extend into the card receiving room so as to mate with the electrical card. The soldering portions 332 of the terminals 33 are arranged along a line and soldered with the minimized printed circuit board 4 in the present embodiment and in another embodiment, is directly soldered with the flexible circuit board 5. The L-shaped base portion 31 forms at least a column 341, and in a preferred embodiment, three columns 34 arranged in a triangle on an lower surface 34 thereof.

In assembly, the metal shield 1 integrates with the insulated housing 2 because of the protrusions 221 and the corresponding apertures 111 and then, an association of the metal shield 1 and the insulated housing 2 is locked on a mother board (not shown) first; in this embodiment, the rectangular base portion 32 of the terminal module 3 is soldered with the minimized printed circuit board 4 and the minimized printed circuit board 4 is connected with the flexible circuit board 5 to become an integration, in another embodiment of this invention, the soldering portions 332 of the terminals 33 are directly connected with the flexible circuit board 5; then, the terminal module 3 is inserted into the second receiving cavity 25 and then confronts the elastic piece 26, because of the guidance of the inclined surface 261, the terminal module 3 goes across the elastic piece 26 and then achieves the first receiving cavity 25 while the columns 34 on the lower surface are received in the corresponding channels 241, and at last, when a front edge of the terminal module 3 fights against the insulated housing 2, a back edge of the terminal module 3 fitly achieves at the upstanding surface 262 and is locked by the upstanding surface 262. The whole assembling process is over, and ultimately, the L-shaped base portion 31 is received in the first receiving cavity 24 and the rectangular base portion 32 is received in the second receiving cavity 25.

The present invention provides a simple assembling process: an association of the metal shield 1 and the insulated housing 2 is first locked on a mother board and then the terminal module 3 slides into the receiving cavities 25, 24 in turn under a guidance of the inclined surface 261 of the elastic piece 26 formed on the insulated housing 2. The terminal module 3 is ultimately locked with the insulated housing 2, in detail, the L-shaped base portion 31 is kept in the first receiving cavity 24 and the rectangular base portion 32 is kept in the second receiving cavity 25 steadily, by the elastic piece 26 which confronts a rear edge of the terminal module 3. So, an improved electrical card connector 100 having a better electrical performance and advanced assembling steps is achieved.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical card connector comprising:

an insulated housing having a receiving cavity and an elastic piece;

a metal shield covering the insulated housing to define a card receiving room and a card insertion/ejection direction; and a terminal module having a plurality of terminals received therein, the terminal module being slidably received in the receiving cavity of the insulated housing along the card ejection direction and fixed in the insulated housing by the elastic piece, wherein the insulated housing defines an upper surface and a lower surface, the upper surface is excavated to leave a first receiving cavity and the lower surface is excavated to leave a second receiving cavity rearwardly of the first receiving cavity, and the two receiving cavities are in communication with each other, wherein the terminal module comprises an L-shaped base portion received in the first receiving cavity and a rectangular base portion received in the second receiving cavity, wherein the elastic piece is formed on a portion of the insulated housing where the second receiving cavity is defined, wherein the elastic piece comprises an inclined surface and an upstanding surface.

2. The electrical card connector as described in claim 1, wherein a portion of the insulated housing below the first receiving cavity defines a plurality of channels extending along the card insertion/ejection direction.

3. The electrical card connector as described in claim 2, wherein the terminal module comprises at least one column received in a corresponding channel.

4. The electrical card connector as described in claim 3, wherein the terminal module comprises three columns arranged in a triangle.

5. The electrical card connector as described in claim 1, wherein each terminal comprises a contact portion and a soldering portion and wherein the contact portions of the terminals are arranged in two-row arrays and extend into the card receiving room.

6. The electrical card connector as described in claim 5, further comprising a minimized printed circuit board and wherein the soldering portions are arranged along a line and soldered with the minimized circuit board.

7. The electrical card connector as described in claim 6, further comprising a flexible circuit board soldered with the minimized printed circuit board.

8. An electrical card connector comprising:

an insulated housing having a first receiving cavity, a second receiving cavity respectively excavated on an upper surface and a lower surface thereof and an elastic piece formed at a rear part of the lower surface, wherein the two receiving cavities are communication with each other;

a metal shield covering the insulated housing to define a card receiving room and a card insertion/ejection direction; and a terminal module having a plurality of terminals received therein, the terminal module divided into a first base portion at a front part thereof and a second base portion at a rear part thereof respectively received in the first and second receiving cavities, the terminal module being slidably received in the receiving cavity of the insulated housing along the card ejection direction and fixed in the insulated housing by the elastic piece, wherein the elastic piece is formed on a portion of the insulated housing where the second receiving cavity is defined, wherein the elastic piece comprises an inclined surface and an upstanding surface.

9. An electrical card connector comprising:

an insulated housing having a first small receiving cavity and a second small receiving cavity communicating with each other while essentially being of different levels;

a metal shield covering the insulated housing to define a large card receiving room and a card insertion/ejection direction;

a terminal module having a plurality of terminals received therein and assembled to the housing in the first small receiving cavity; and a rigid printed circuit board located behind the terminal module and received in the second small receiving cavity; wherein each of said terminals includes a front contact section extending into the receiving room and a rear tail section soldered upon a front region of the rigid printed circuit board; wherein a flexible printed circuit board is further connected to a rear region of the rigid printed circuit board and extending rearwardly out of the connector.

* * * * *